US005418352A

United States Patent [19]

Cho

[11] Patent Number: 5,418,352

[45] Date of Patent: May 23, 1995

[54] DEVICE FOR SHIELDING LEAKAGE OF HIGH FREQUENCY WAVES IN A MICROWAVE OVEN

[75] Inventor: Gyu W. Cho, Kyungki-Do, Rep. of Korea

[73] Assignee: Goldstar Co., Ltd., Seoul, Rep. of Korea

[21] Appl. No.: 148,373

[22] Filed: Nov. 8, 1993

[30] Foreign Application Priority Data

Nov. 10, 1992 [KR] Rep. of Korea ..... 1992-22010

[51] Int. Cl.[6] ..... H05B 6/76

[52] U.S. Cl. ..... 219/742; 219/743; 174/35 GC

[58] Field of Search ..... 219/741, 742, 743; 174/35 R, 35 GC

[56] References Cited

U.S. PATENT DOCUMENTS

| | | | |
|---|---|---|---|
| 4,523,069 | 6/1985 | Staats | 219/742 |
| 4,584,447 | 4/1986 | Kusunoki et al. | 219/742 |
| 4,659,891 | 4/1987 | Yamaguchi et al. | 219/743 |
| 4,700,034 | 10/1987 | Lee | 219/742 |
| 4,742,201 | 5/1988 | Nakano et al. | 219/742 |
| 5,036,171 | 7/1991 | Kim et al. | 219/742 |

*Primary Examiner*—Philip H. Leung

*Attorney, Agent, or Firm*—Fliesler, Dubb, Meyer & Lovejoy

[57] ABSTRACT

A device for shielding a leakage of high frequency waves in a microwave oven, capable of effectively shielding high frequency waves leaked without using any ferrite rubber and reducing the thickness of a door of the microwave oven to achieve a compactness of the microwave oven. The device includes an outer panel, an inner panel fixedly mounted to the outer panel to define a choke channel therebetween, the inner panel having a first bent portion and a second bent portion, a pair of capacitive seals provided at portions of the inner panel facing a front panel of the microwave oven, a plurality of slits formed at the first bent portion at intervals and adapted to attenuate high frequency waves advancing in a X-axis direction, and a choke cover fitted in the second bent portion and adapted to close an opened portion of the choke channel.

2 Claims, 3 Drawing Sheets

DEVICE FOR SHIELDING LEAKAGE OF HIGH FREQUENCY WAVES IN A MICROWAVE OVEN

BACKGROUND OF THE INVENTION

1. Field of the Invention

The present invention relates to a device for shielding a leakage of high frequency waves in a microwave oven, and more particularly to a high frequency wave shielding device for shielding high frequency waves outwardly leaked through a gap between a door and a front panel of a heating chamber of a microwave oven.

2. Description of the Prior Art

As well-known, microwave ovens are convenient kitchen appliances wherein high frequency waves generated from a magnetron are radiated on food placed in a heating chamber, so that the food itself generates heat by which the food is cooked. When a person is excessively exposed to high frequency waves, his body may suffer a fatal injury. It is, therefore, required to prevent the high frequency waves from being leaked out of the heating chamber.

Referring to FIG. 1, a general construction of a microwave oven is illustrated. As shown in FIG. 1, the microwave oven comprises a body 1 having a cavity 2 for receiving food to be cooked, a door 3 for opening and closing the cavity 2, and a window glass 4 attached to the door 3 and adapted to enable a user to see the interior of the cavity 2 therethrough.

For shielding a leakage of high frequency waves between a front panel 5 of the cavity 2 and the door 3 in the above-mentioned construction, a $\lambda \cdot g/4$ choke channel 8 of a rectangular shape having a predetermined length L and a predetermined width W is defined by inner and outer metal panels 6 and 7, as shown in FIG. 2. The inner panel 6 extends upwardly up to an approximate middle portion of the choke channel 8 and is bent at its upper end toward the choke channel 8 so as to define an opening positioned over the inner panel 6. The opening is closed by a choke cover 10 attached at its inner surface with a ferrite rubber 9.

A capacitive seal 11 is formed between the front panel 5 of the cavity 2 and the inner panel 6 of the choke channel 8.

A transmission line path defined in a region at which the capacitive seal 11 is formed has a wave number km expressed by the following equation:

$$km = \sqrt{Ko^2 - (n\pi/b)^2}$$

wherein, Ko represents $2\pi/\lambda$ and b represents the space between the front panel 5 and the inner panel 2.

Where the value of b is very small, only the waves of the transverse electric magnetic wave mode (TEM mode) can be transmitted while the waves of the transverse electric wave mode (TE mode) and the waves of the transverse magnetic wave mode (TM mode) are shielded.

In other words, in case of the waves of TEM mode, the characteristic impedance of a parallel transmission line path is proportional to $b \cdot \mu/\epsilon$ (wherein, $\mu$ and $\epsilon$ represent a permeability and a permittivity, respectively). Accordingly, it is possible to reflect high frequency waves leaked out of the cavity 2 by greatly decreasing the value of b or increasing the value of $\epsilon$.

The lower horizontal portion 7a of the outer panel 7 constituting the choke channel 8 is a short surface exhibiting the impedance of zero. Assuming that the choke channel 8 is a transmission line path, the input impedance Zin at a position departed from a load ZL by a length l can be expressed by the following equation, as shown in FIG. 5:

$$Zin = \frac{ZL + jZo \cdot \tan\beta l}{Zo + jZL \cdot \tan\beta l}$$

wherein, Zo represents the characteristic impedance of the transmission line path and $\beta$ represents a phase constant determined by the construction of the transmission line path.

Assuming that ZL of the above equation is zero, the input impedance Zin corresponds to $jZo \cdot \tan\beta l$. In this case, the input impedance Zin becomes the infinity ($Zin = \infty$) when the length l is $\lambda \cdot g/4$. When the length l is $\lambda \cdot g/2$, the input impedance Zin becomes zero (Zin: 0).

As a result, where high frequency wave energy present in the interior of the cavity 2 is introduced in the interior of the choke channel 8 along a path B communicating with a point D during its leakage from a point A to a point B, the impedance at the point D can be determined by positioning the point D at a position departed a distance of $\lambda \cdot g/4$ from the short surface exhibiting the impedance of zero. In this case, the choke channel 8 generates a resonance and thus reflects high frequency wave energy toward the cavity 2. As a result, it is possible to shield high frequency waves outwardly leaked.

In the above-mentioned conventional construction of the choke channel 8, however, the transmission of high frequency wave energy is achieved not only in the TEM mode, but also in the TE mode or the TM mode when the space between the inner panel 6 of the choke channel 8 and the front panel 5 of the cavity 2 is large. This requires the use of the $\lambda \cdot g/4$ choke channel 8 and the expensive ferrite rubber 9 so as to prevent the leakage of high frequency waves. As a result, the manufacturing cost is increased. Furthermore, there is a drawback that the door 3 has an increased thickness because the choke channel 8 has a relatively large width and length.

SUMMARY OF THE INVENTION

Therefore an object of the invention is to provide a device for shielding leakage of high frequency waves in a microwave oven, capable of effectively shielding high frequency waves advancing in X-axis and Z-axis directions without using any ferrite rubber, by virtue of a changed construction of a choke channel.

In accordance with the present invention, this object can be accomplished by providing a device for shielding leakage of high frequency waves in a microwave oven, comprising: an outer panel; an inner panel fixedly mounted to said outer panel to define a choke channel therebetween, said inner panel having a first bent portion and a second bent portion; a pair of capacitive seals provided at portions of the inner panel facing a front panel of said microwave oven; a plurality of slits formed at said first bent portion at intervals and adapted to attenuate high frequency waves advancing in a X-axis direction; and a choke cover fitted in said second bent portion and adapted to close an opened portion of said choke channel.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Referring to FIGS. 3 to 6, there is illustrated a device for shielding a leakage of high frequency waves in a microwave oven in accordance with the present invention.

Figure 1:
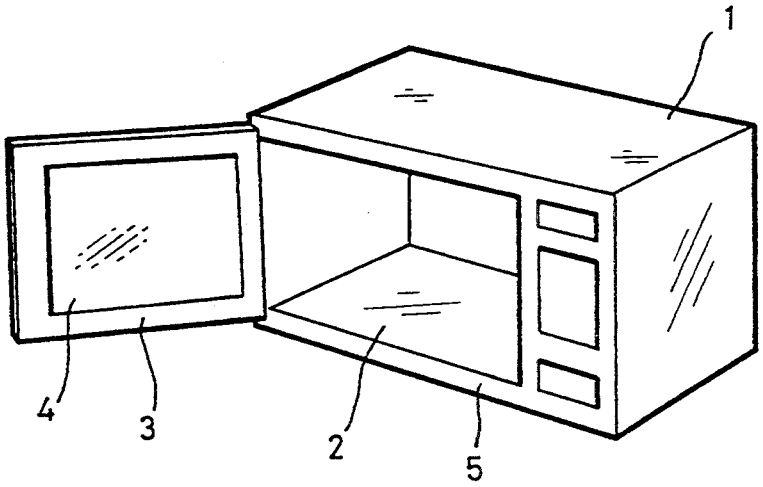
FIG.1 (CONVENTIONAL ART)
FIG. 1 is a perspective view of a microwave oven of the general type.
Figure 2:
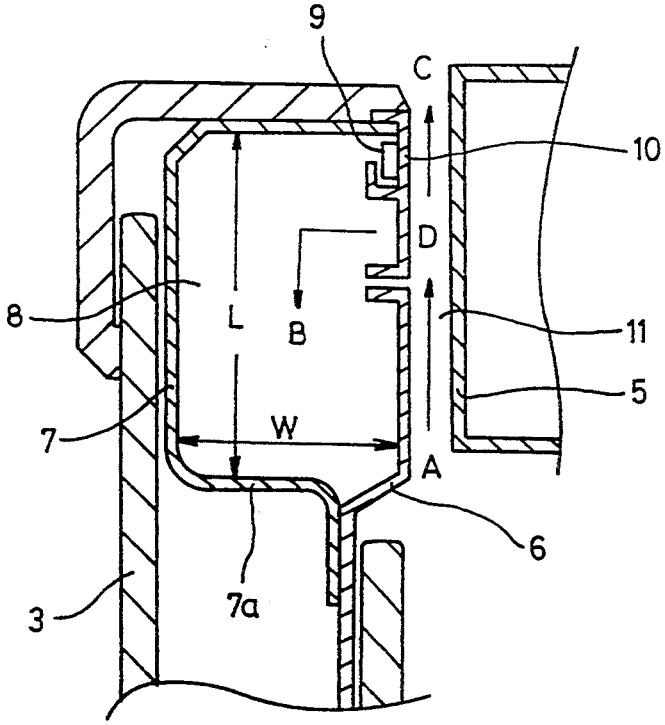
FIG.2 (CONVENTIONAL ART)
FIG. 2 is a sectional view of a conventional high frequency wave shielding device.
Figure 3:
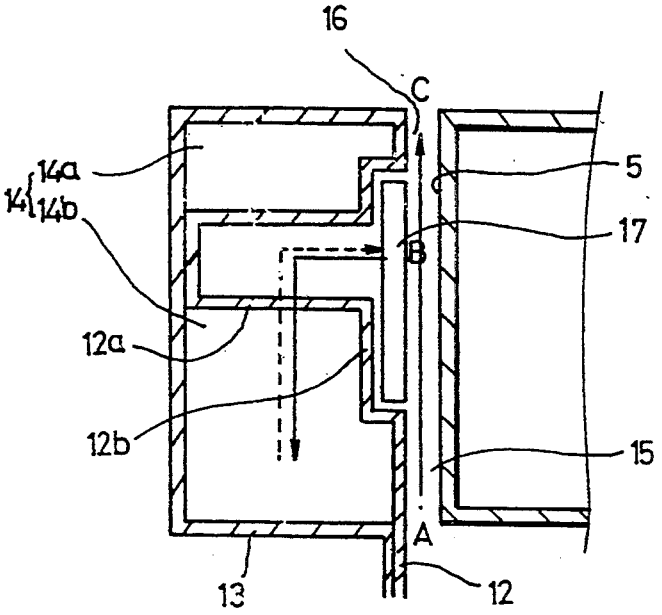
FIG. 3 is a sectional view of a high frequency wave shielding device in accordance with the present invention.
Figure 4:
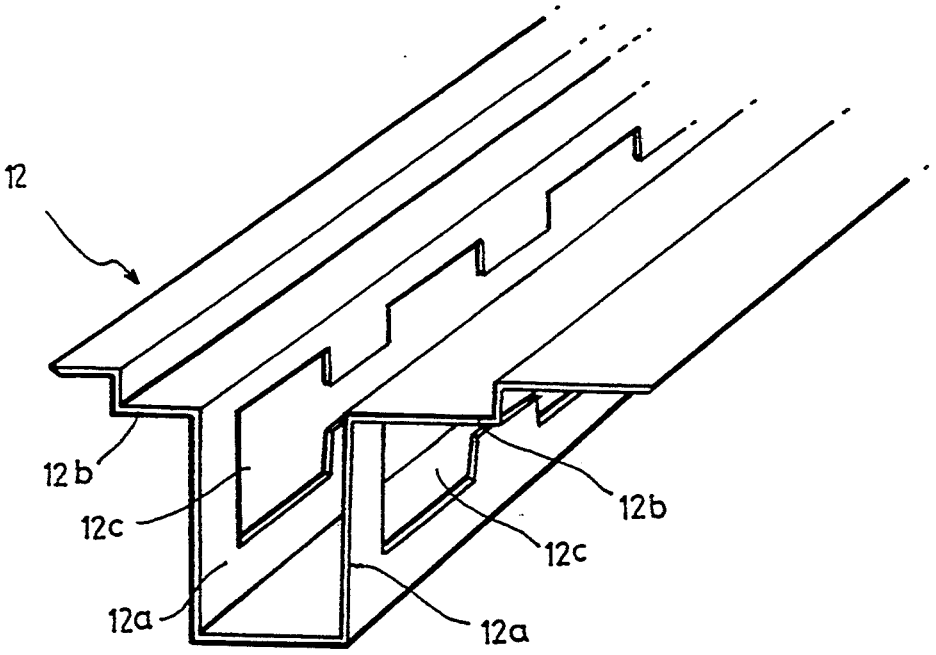
FIG. 4 is a perspective view of an inner panel of the high frequency wave shielding device in accordance with the present invention.
Figure 5:
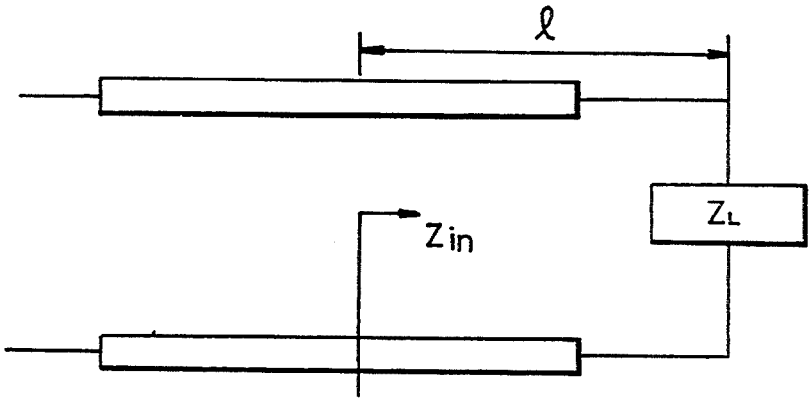
FIG. 5 is a schematic view illustrating an impedance relation at a transmission line path.
Figure 6:
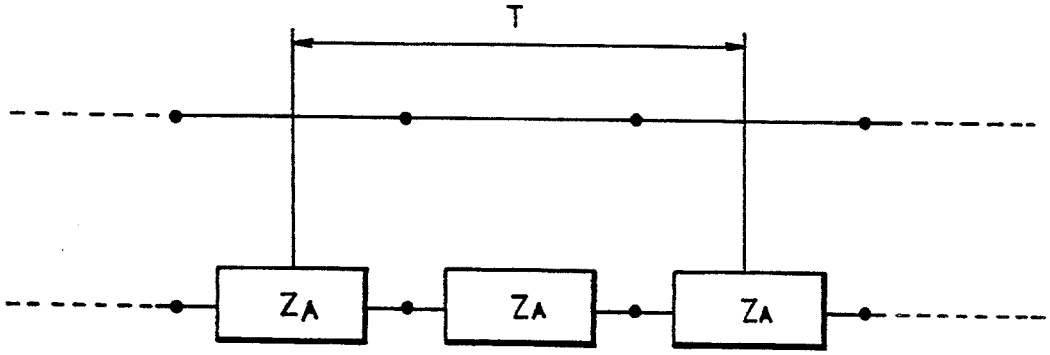
FIG. 6 is a schematic view illustrating an example of a periodic transmission line path.

FIG. 3 is a sectional view of a main part of the high frequency wave shielding device in accordance with the present invention. FIG. 4 is a perspective view of an inner panel of the high frequency wave shielding device in accordance with the present invention. FIG. 5 is a schematic view illustrating an impedance relation at a transmission line path. FIG. 6 is a schematic view illustrating an example of a periodic transmission line path.

The high frequency wave shielding device of the present invention comprises a pair of spaced panels 12 and 13. The inner panel 12 is fixedly mounted to the outer panel 13 and spaced from a front panel 5 of the microwave oven. The inner panel 12 has a first bent portion 12*a* and a second bent portion 12*b*. Between the panels 12 and 13, a $\lambda \cdot g/4$ choke channel 14 is defined.

In terms of workability, it is preferred that the inner panel 12 is integral with the outer panel 13. Of course, the inner panel 12 can be made separately from the outer panel 13.

At facing portions of the inner panel 12 and the front panel 5, a first capacitive seal 15 and a second capacitive seal 16 are formed, respectively. A plurality of uniformly spaced slits 12*c* are formed at the first bent portion 12*a* of the inner panel 12 and adapted to attenuate high frequency waves advancing in the X-axis direction.

The first and second capacitive seals 15 and 16 formed at facing portions of the inner panel 12 and the front panel 5 perform a double capacitive sealing function for high frequency waves leaked through a gap between the front panel 5 and the inner panel 12, thereby shielding the leakage of high frequency waves.

For closing the choke channel 14, a choke cover 17 is fitted in the second bent portion 12*b* of the inner panel 12.

On the other hand, the first bent portion 12*a* of the inner panel 12 has an elongated 90°-turned U-shape with a face being in contact with the outer panel 13. By this construction, the choke channel 14 is divided into a first resonance chamber 14*a* and a second resonation chamber 14*b*.

As the choke channel 14 is divided into a first resonance chamber 14*a* and a second resonance chamber 14*b*, high frequency waves passing through the first capacitive seal 15 meet high frequency waves emerging from the choke channel 14, but not attenuated yet, so that they are secondarily attenuated. Thus a double attenuation effect is obtained.

The second bent portion 12*b* is constructed by bending the inner panel 12 such that the infinite impedance is obtained at its portion to be opened when the inner panel 12 having the length of $\lambda \cdot g/4$ is installed, so as to shield high frequency waves. As a result, the second bent portion 12*b* of the inner panel 12 performs a fringing capacitive function while reducing the length of the inner panel 12. This means that the length of the front panel 13 can be reduced below $\lambda \cdot g/4$ and yet the same effect can be obtained.

Operation of the high frequency wave shielding device having the above-mentioned construction in accordance with the present invention will now be described.

When high frequency waves emerging from a cavity of the microwave oven are introduced in a space defined by the first bent portion 12*a* of the inner panel 12 through the gap between the front panel 5 and the inner panel 12, the uniformly spaced slits 12*c* formed at the first bent portion 12*a* serve as a band stop filter for high frequency wave energy advancing in the X-axis direction to prevent the high frequency waves from being leaked in the X-axis direction.

Where a periodical construction is provided at a certain frequency guide (namely, the first bent portion of the inner panel in the construction of the present invention), it changes the pulse or the phase of high frequency waves passing therethrough so as to shield the advance of the high frequency waves. Such a periodical construction is called a band stop filter.

The slits 12*c* formed at the first bent portion 12*a* of the inner panel 12 have an interval T of $\lambda \cdot g/4$. The dimension of each slit 12*c* can be determined theoretically or experimentally.

The above-mentioned periodical construction constituted by the slits 12*c* serves as a fringing capacitor.

In other words, a capacitance fringing phenomenon occurs at vertical portions between the front panel 5 and each slit 12*c* and between each slit 12*c* and the portion of the outer panel 13 defining the choke channel 14. The filtering function of the periodical construction provided by the slits 12*c* can be explained by the modeling of a periodical transmission line path shown in FIG. 6.

The modeling of a transmission line path is constituted by a plurality of impedances ZA equivalently spaced at the interval T.

Such a transmission line path has a characteristic that high frequency waves passing through the transmission line path exhibit a propagation band and a cut-off band alternatingly, as apparent from the $\beta$-f characteristic diagram depicting the relation between the phase constant B and the frequency f.

The leakage of high frequency waves in the X-axis direction can be prevented by determining the transmission line path condition by use of the above characteristic relation such that the frequency of the high frequency waves is included within the frequency range of the cut-off bared.

On the other hand, high frequency waves advancing in the Z-axis direction are attenuated in the $\lambda \cdot g/4$ choke channel 14, namely, the first resonance chamber 14*a* and the second resonance chamber 14*b*. Where high frequency wave energy flows from a point A of the cavity to an external point C, the impedance relation at the cavity can be expressed by jx.

Therefore, when the point where jx is infinite is positioned on a transmission line path extending from the point A to the point C, this transmission line path is opened (infinite impedance), thereby shielding the leakage of high frequency wave energy.

In other words, the first capacitive seal 15 and a second capacitive seal 16 which are provided at respective portions of the front panel 5 and the inner panel 12 facing at a door-closed state serve as capacitive seals for attenuating high frequency waves advancing the Z-axis direction.

Since the choke channel 14 is constituted by the first resonance chamber 14*a* and the second resonance chamber 14*b*, the high frequency wave emerging from the first capacitive seal 15 advances directly to the second capacitive seal 16. The high frequency waves being resonated in the first and second resonance chambers 14*a* and 14*b* advance to the gap between the front panel 5 and the inner panel 12 via the choke cover 17. As a result, they meet at a crossing point, namely, the point B of FIG. 3 to be offset from each other, thereby enabling the high frequency waves advancing in the C-axis direction to be shielded.

As apparent from the above description, the present invention provides a high frequency wave shielding device including a pair of capacitors provided between a front panel and an inner panel and a choke channel divided into a pair of resonance chambers, thereby enabling a double shielding for high frequency waves advancing in the Z-axis direction. In accordance with the present invention, the inner panel has a first, bent, portion provided with a plurality of slits formed at, intervals and adapted to shield high frequency waves advancing in the X-axis direction. As a result, the use of an expensive ferrite rubber i s unnecessary.

In accordance with the present, invention, the inner panel also has a second bent, portion construct to obtain the infinite impedance at, an opened portion of the inner panel. As a result, it, is possible to reduce the thickness of the door and thus achieve a compactness of the door.

Although the preferred embodiments of the invention have been disclosed for illustrative purposes, those skilled in the art will appreciate that various modifications, additions and substitutions are possible, without, departing from the scope and spirit of the invention as disclosed in the accompanying claims.

What is claimed is:

1. A device for shielding leakage of high frequency waves from a microwave oven, said device adapted to be juxtaposed a front panel of the microwave oven, said device comprising:

an outer panel and an inner panel formed in one piece;

said inner panel being connected to said outer panel to define a choke channel therebetween, said inner panel having a first bent portion and a second bent portion forming first and second resonance chambers within the choke channel; a pair of capacitive seals provided at portions of the inner panel which face the front panel of said microwave oven;

a plurality of slits formed at said first bent portion at intervals and adapted to attenuate high frequency waves; and a choke cover fitted in said second bent portion and adapted to close an opened portion of said choke channel.

2. A device in accordance with claim 1, wherein said first bent portion has a face being in contact with said outer panel, whereby said choke channel is divided into said first resonance chamber and said second resonance chamber.

* * * * *